US006428293B1

(12) United States Patent
Dewar et al.

(10) Patent No.: US 6,428,293 B1
(45) Date of Patent: Aug. 6, 2002

(54) HEAT SHIELD WITH SEAL BETWEEN END CAP AND NON-ORBITING SCROLL

(75) Inventors: Todd W. Dewar, Abingdon, VA (US); Zili Sun, Arkadelphia, AR (US); Thomas R. Barito, Arkadelphia, AR (US); Robert C. Witham, Arkadelphia, AR (US); Gregory W. Hahn, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/829,327

(22) Filed: Apr. 9, 2001

(51) Int. Cl.[7] ..... F01C 1/02
(52) U.S. Cl. ..... 418/55.1; 418/55.4; 418/83
(58) Field of Search ..... 418/55.1, 55.4, 418/83

(56) References Cited

U.S. PATENT DOCUMENTS 5,487,654 A * 1/1996 Wallis et al. ..... 418/55.1
5,649,816 A * 7/1997 Wallis et al. ..... 418/55.1
5,674,062 A * 10/1997 Weatherston ..... 418/55.1

FOREIGN PATENT DOCUMENTS

JP 57-206786 * 12/1982 ..... 418/83
JP 08-210273 * 8/1996 ..... 418/83

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

An improved heat shield for a scroll compressor is provided with a non-cylindrical end portion caught between the end cap and the non-orbiting scroll. In several embodiments, the portion provides a seal between the discharge chamber and a suction chamber. In one embodiment the portion of the heat shield is serpentine. In another embodiment the portion of the heat shield is generally u-shaped. In further embodiments the portion includes a plurality of circumferentially spaced clips. Several other embodiments are also disclosed.

24 Claims, 5 Drawing Sheets

HEAT SHIELD WITH SEAL BETWEEN END CAP AND NON-ORBITING SCROLL

BACKGROUND OF THE INVENTION

This invention relates to an improved heat shield to be positioned between a housing end cap and a non-orbiting scroll wherein a seal is provided by structure on the end cap.

Scroll compressors are becoming widely utilized in refrigerant compression applications. In a scroll compressor a first scroll member has a base and a generally spiral wrap extending from its base. A second scroll member also has a base and a generally spiral wrap extending from its base. The two wraps interfit to define compression chambers. The second scroll member is driven to orbit relative to the first scroll member and the size of the compression chambers is decreased, compressing an entrapped refrigerant.

In a scroll compressor, the refrigerant being compressed is often passed over the electric motor when entering the compressor through a suction tube. This flow of suction refrigerant cools the motor. However, flowing the suction refrigerant over the motor requires that there be a seal within the compressor housing between a discharge chamber and a suction chamber. Typically, some separator plate has been incorporated extending across the interior of the compressor housing to define both a suction and discharge chamber.

More recently, scroll compressors have been developed which do not utilize a separator plate, but instead separates the discharge and suction chambers through the structure of the first scroll member described above. With such an application, it becomes desirable to provide a heat insulating structure between the non-orbiting scroll and the discharge chamber. Thus, a heat shield has been proposed in co-pending patent application Ser. No. 09/451306 filed Nov. 29, 1999.

While such a compressor has proven quite successful, it would be desirable to improve upon this structure, and in particular, utilize the heat shield in conjunction with the non-orbiting scroll and a housing end cap to provide a seal.

SUMMARY OF THE INVENTION

In the disclosed embodiment of this invention, the heat shield has a downwardly extending portion which is non-cylindrical such that it will contact both the non-orbiting scroll and the end cap of the housing to provide an adequate seal between the discharge chamber and the suction chamber. In one embodiment, the end portion of the heat shield is serpentine, or generally s-shaped, such that portions of the heat shield will contact the outer periphery of the non-orbiting scroll, and another portion will contact the inner periphery of the end cap. When the housing members are brought together, the connection ensures adequate sealing between the discharge and suction chambers.

In another embodiment, the end portion is generally u-shaped. Again, when the housing members are brought together, there will be an adequate seal between the inner periphery of the end cap and the outer periphery of the non-orbiting scroll.

In other embodiments, the end portion extends radially outwardly and circumferentially around the heat shield. In one embodiment, there is a raised rib that will be squeezed between the upper shell and the non-orbiting scroll. In another embodiment, the edge is wrapped back radially inwardly to provide the sealing portion. In yet another embodiment, a sealing material is bonded to the radially outer portion.

In further embodiments, the heat shield has inwardly extending clip portions which fit into a groove on the outer periphery of the non-orbiting scroll. This structure positions the heat shield at a desired position on the non-orbiting scroll ensuring that the end cap and non-orbiting scroll together compress the heat shield to achieve a seal between the discharge and pressure chambers. In one embodiment this seal is provided by the heat shield, while in another embodiment the seal is provided between the non-orbiting scroll and the end cap.

Several other embodiments are also included. In some embodiments, the heat shield has a inwardly extending u-shaped portion fitting into a groove within the non-orbiting scroll. In another embodiment, the heat shield has a generally radially outwardly extending portion which is bent axially downwardly by the end cap. In yet another embodiment, there is a generally u-shaped portion on the heat shield extending axially into a ditch in the non-orbiting scroll, and then a radially outer portion extending from the u-shaped portion.

In further embodiments, there are ribs on either the non-orbiting scroll, or the heat shield. The ribs will provide a crush point to provide a seal. The ribs are placed in various locations on the two elements.

In further embodiments, the heat shield has an upwardly extending portion which abuts an inner end of the end cap. In yet another embodiment, the heat shield has a radially outwardly extending portion which extends to an axially lower portion fitting into a groove in the non-orbiting scroll. In yet another embodiment, a radially outer portion of the heat shield is deformed axially downwardly by the end cap. In many of the embodiments, there may also be resilient material added to the sealing portion of the heat shield.

These and other features of the present invention can be best understood from the following specification and drawings, the following of which is a brief description.

DETAILED DESCRIPTION OF A PREFERRED EMBODIMENT

Figure 1A:
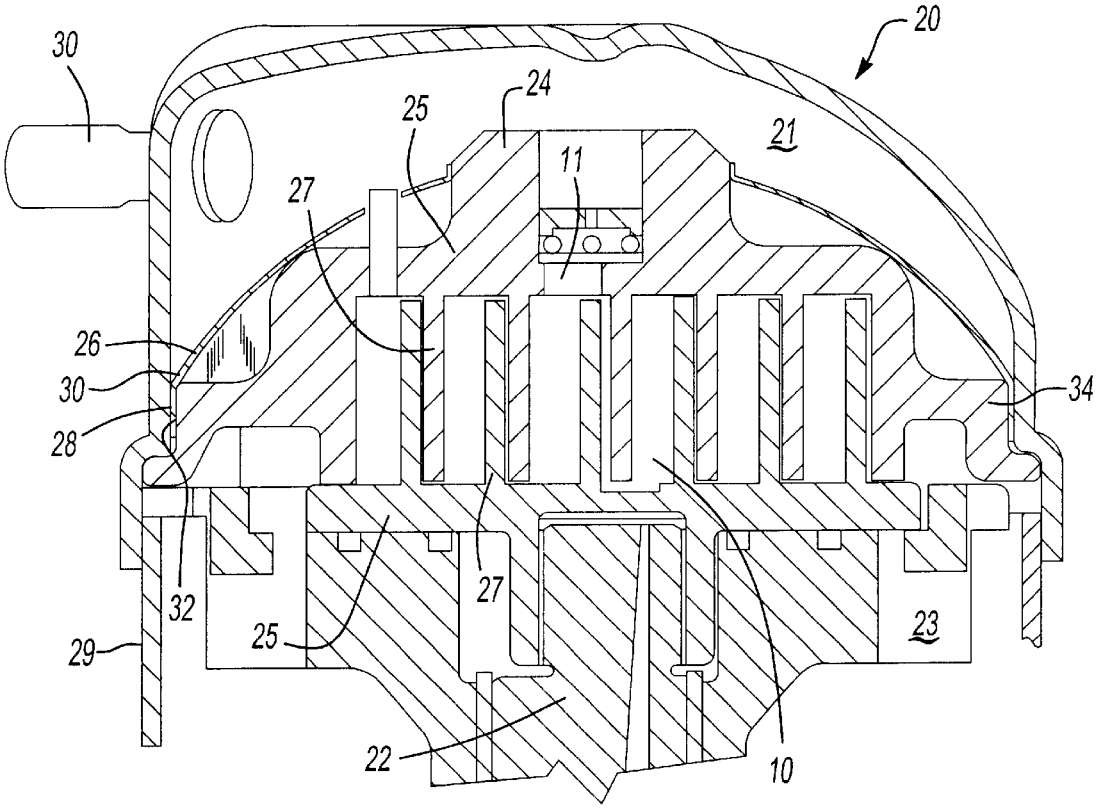
FIG. 1A shows a scroll compressor incorporating the present invention.

A scroll compressor 20 is illustrated in FIG. 1A defining a discharge chamber 21 and a suction chamber 23. The orbiting scroll 22 orbits relative to a non-orbiting scroll 24. A heat shield 26 is positioned outwardly of the base of the non-orbiting scroll, and insulates the discharge chamber 21 from the rear of the base of the non-orbiting scroll 24. The orbiting scroll 22 and the non-orbiting scroll 24 each include a base 25, 125 and a spiral wrap 27, 127. Compression chambers 10 are defined between the wraps, and the compression chambers open to a discharge port 11.

An end cap 28 is secured to a central housing shell 29. An inner periphery 30 of end cap 28 and an outer peripheral surface 32 of the non-orbiting scroll 24 compresses structure at the end 34 of the heat shield 26 to provide an adequate seal between chambers 21 and 23.

Figure 1B:
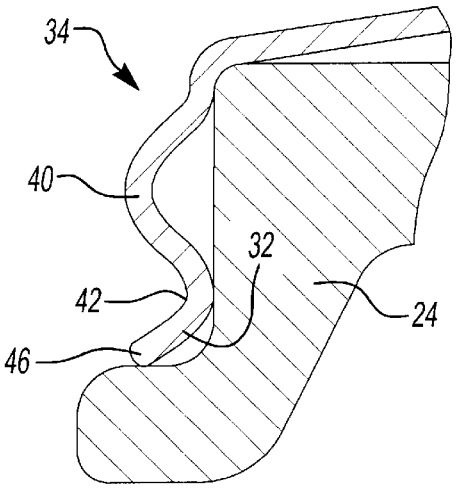
FIG. 1B shows a view of the inventive heat shield.

As shown in FIG. 1B, the structure 34 includes a serpentine shape having outwardly facing u-half 40 and inwardly facing u-half 42 along with an end portion 46 which extends generally cylindrically. While FIG. 1A exaggerates the amount of compression that may occur within the serpentine shape 34, it can be appreciated that the inner periphery of portion 42 will provide a press fit on the outer surface 32 of the non-orbiting scroll 24. At the same time, a press fit is provided between the inner periphery 30 of the end cap 28 and outer periphery of the outwardly extending u-half 40. Thus, when the end cap 28 is secured to the central shell and around the non-orbiting scroll 24, there is a press fit both at surfaces formed by halves 40 and 42. While the halves may not be compressed to the extent shown in FIG. 1A, it is preferred that the press fit be relatively tight to ensure a positive and reliable seal between chambers 21 and 23.

Figure 2:
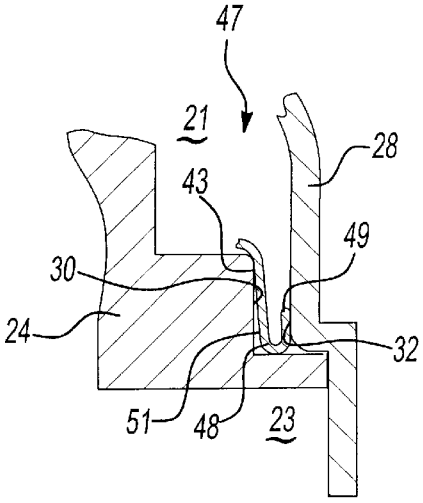
FIG. 2 shows a second embodiment heat shield.

FIG. 2 shows another embodiment 47 wherein the heat shield 43 has a u-shape downwardly extending portion 48 with an outwardly extending end 49 providing a press fit with the inner surface 32 of the end cap 28. The u-shaped end portion 48 further provides a press fit such as at point 51 of the outer periphery of the non-orbiting scroll 24. As in the prior embodiment, this provides a seal between the chambers 21 and 23.

Figure 3:
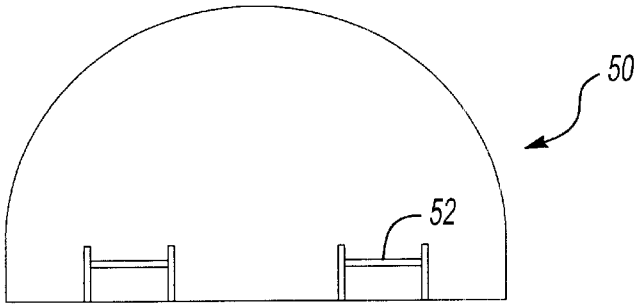
FIG. 3 shows a third embodiment heat shield.
Figure 4:
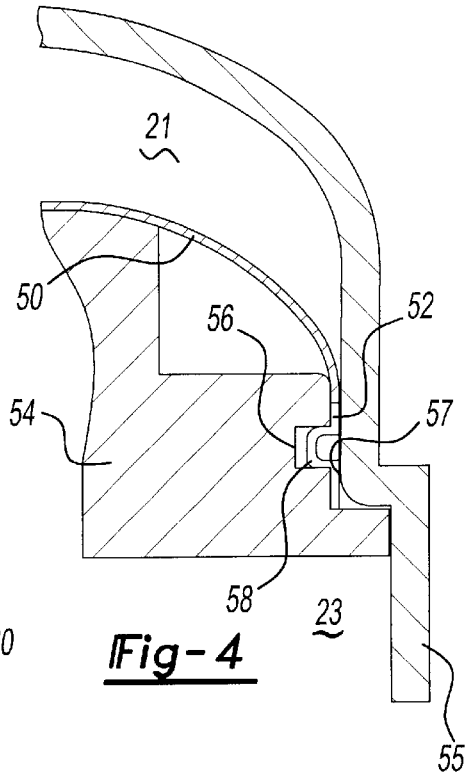
FIG. 4 shows a third embodiment heat shield attached between the compressor housing elements.

FIG. 3 shows another embodiment 50 wherein a plurality of inwardly extending clip portions 52 are circumferentially spaced about the heat shield. As shown in FIG. 4, the portions 52 extend into a groove 56 in the non-orbiting scroll 54. The inner periphery 57 of the end cap 55 is press fit onto the outer periphery of the heat shield 50, such that the clip portion inwardly extending lip 58 is forced into the groove 56, locking the heat shield at a reliable position. At the same time, the press fit of the end cap 55 onto the heat shield 50 provides a seal between chambers 21 and 23. In this embodiment, the heat shield is first assembled onto the non-orbiting scroll by clipping the heat shield into the groove 56. The upper shell can then be press fit onto the assembly.

Figure 5:
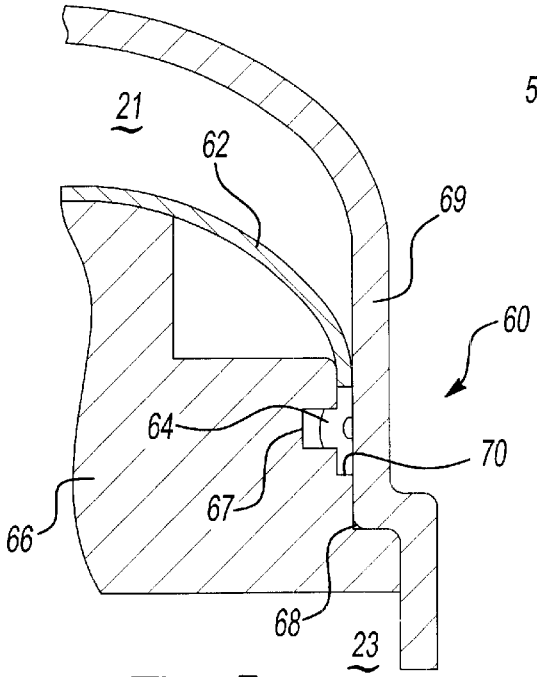
FIG. 5 shows a fourth embodiment heat shield.

FIG. 5 shows another embodiment 60 wherein the heat shield 62 is provided with a plurality of circumferentially spaced clips 64 as in FIGS. 3 and 4. In this embodiment, however, the seal is provided between the outer periphery 68 of the non-orbiting scroll 66 and the inner periphery 70 of the end cap 69. The groove 67 and clip 64 provide the positive positioning of the heat shield 62 and ensure the seal between surfaces 68 and 70 will positively seal between the chambers 21 and 23.

Figure 6:
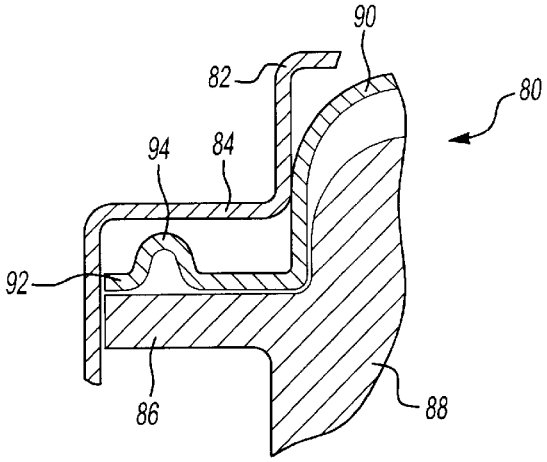
FIG. 6 shows another embodiment heat shield.

FIG. 6 shows an embodiment 80 wherein the upper shell 82 has a radially outwardly extending ledge 84 which will be aligned with a similar ledge 86 on the non-orbiting scroll 88. The heat shield 90 has a radially outwardly extending flange 92. In this flange is formed a raised circumferential rib 94. In forming the compressor, the upper shell is pressed onto the center shell, deforming the raised rib 94 to provide the seal.

Figure 7:
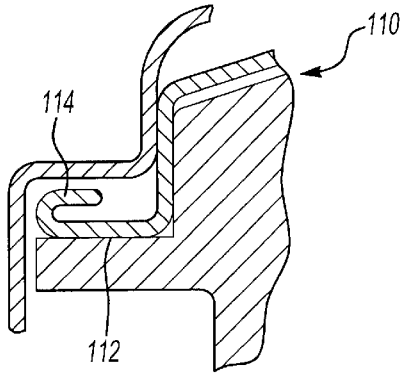
FIG. 7 shows yet another embodiment.

As shown in FIG. 7, an embodiment 110 has the radially outwardly extending flange 112 which has a radially inwardly extending edge wrap 114. Again, when the upper shell is pressed on, this edge 114 will become deformed, providing the seal.

Figure 8:
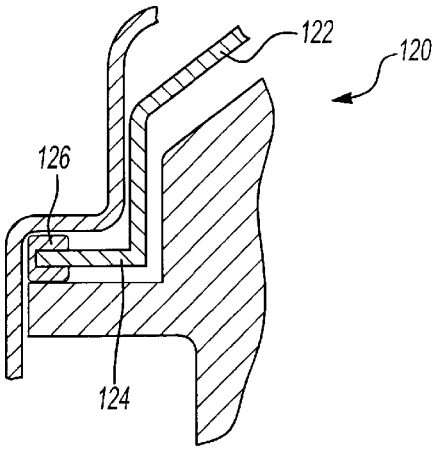
FIG. 8 shows yet another embodiment.

FIG. 8 shows yet another embodiment 120. In embodiment 120, the heat shield 122 has the radially outwardly extending flange 124. A material 126 is preferably placed on both axial sides of the flange 124. The material is preferably of a material providing a better seal than the material of the heat shield. As an example, Teflon, brass, aluminum, or other soft materials which are compatible with exposure to refrigerants could be utilized.

Figure 9:
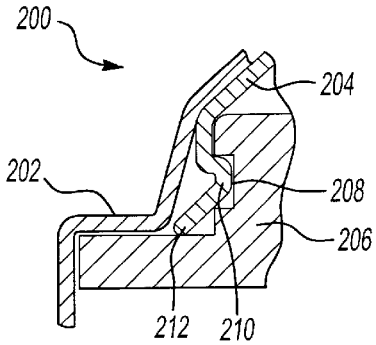
FIG. 9 shows another embodiment.

FIG. 9 shows an embodiment 200 wherein the end cap 202 captures the heat shield 204. The heat shield 204 is sealed to the non-orbiting scroll 206 which has a circumferentially ditch 208. A u-shaped radially inwardly extending portion 210 of the heat shield extends into the ditch. An axially lower portion 212 extends from the u-shaped portion 210.

Figure 10A:
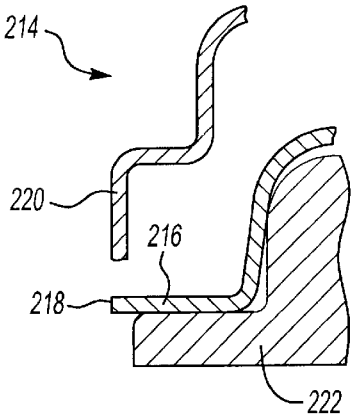
FIG. 10A shows a first stage in yet another embodiment.
Figure 10B:
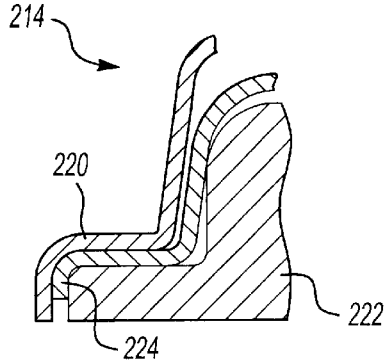
FIG. 10B shows the final stage of the FIG. 10A embodiment.

FIG. 10A shows an embodiment 214 wherein the heat shield 216 has a radially outwardly extending portion 218. The radially outwardly extending portion 218 is captured between the end cap 220 and the non-orbiting scroll 222. As shown in FIG. 10B, the axially lower end 224 of the heat shield is deformed by the end cap 220 to be cylindrical. In this embodiment, it is still true that the heat shield, as formed and as shown in FIG. 10A, does have a non-cylindrical lower portion, namely outwardly extending portion 218.

Figure 11:
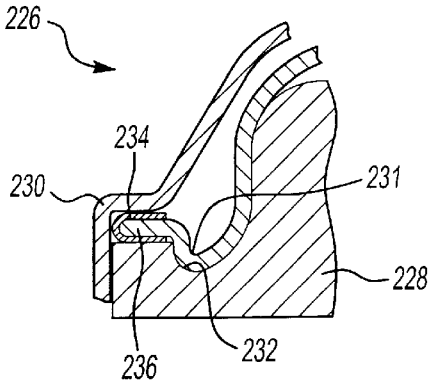
FIG. 11 shows yet another embodiment.

FIG. 11 shows another embodiment 226 wherein the non-orbiting scroll 228 receives the end cap 230 with the heat shield captured between and having a u-shaped portion 231 extending into a ditch 232. The radially outer end 234 of the heat shield receives a resilient material 236 which is captured to provide the seal.

Figure 12:
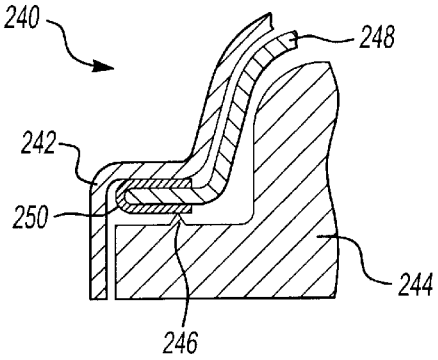
FIG. 12 shows another embodiment.

FIG. 12 shows yet another embodiment 240 wherein the end cap 242 is positioned outwardly of the non-orbiting scroll 244. A raised rib 246 extends upwardly from the non-orbiting scroll 244 and provides a crush point for creating a seal with the heat shield 248. A resilient material 250 (such as material 126) may be placed upon the outer peripheral edge of the heat shield 248. In all of the above and following embodiments, this same resilient material may or may not be used as desired.

Figure 13:
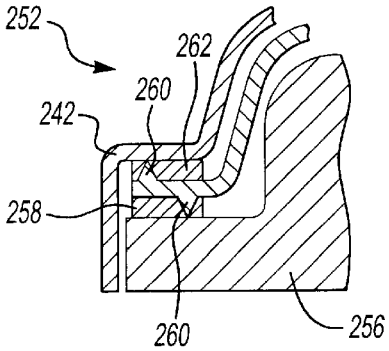
FIG. 13 shows another embodiment.

FIG. 13 shows an embodiment 252 wherein the end cap 254 is positioned outwardly of the non-orbiting scroll 256. The heat shield 258 has a pair of ribs 260 extending in opposed vertical directions. The end cap 254 and the non-orbiting scroll 256 will pinch the heat shield between their two final surfaces, and the ribs 260 will provide a crush point and seal. As shown in this embodiment, resilient material 262 may be utilized. As mentioned previously, the resilient material is optional in this and all following embodiments.

Figure 14:
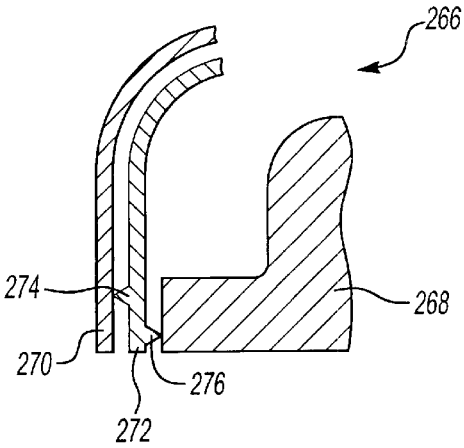
FIG. 14 shows another embodiment.

As shown in FIG. 14, an embodiment 266 is positioned to have a non-orbiting scroll 268 and an end cap 270. The heat shield 272 is captured between the two. Ribs 274 and 276 extend outwardly and inwardly to contact the two members.

Figure 15:
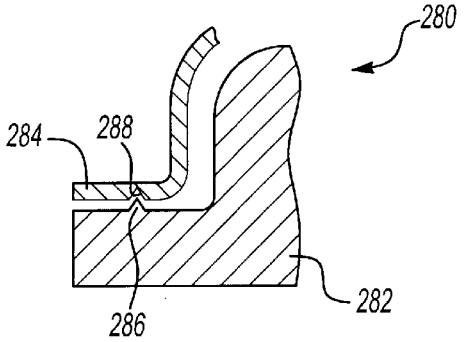
FIG. 15 shows another embodiment.

FIG. 15 shows an embodiment 280 wherein the non-orbiting scroll 282 is positioned inwardly of the insulator plate 284. A rib 286 extends upwardly into a groove 288 in the heat shield 284. Again, the end cap will capture the heat shield, and provide a seal.

Figure 16:
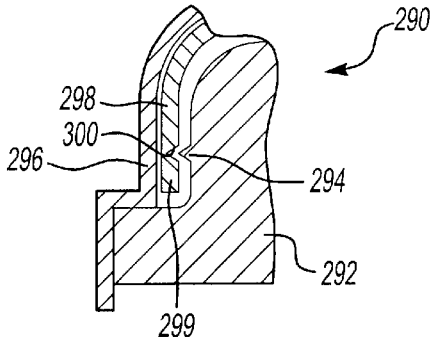
FIG. 16 shows another embodiment.

FIG. 16 shows an embodiment 290 wherein the non-orbiting scroll 292 has an outwardly extending rib 294. The end cap 296 captured the heat shield 298. A groove 300 on the heat shield lower end 299 receives the rib 294.

Figure 17:
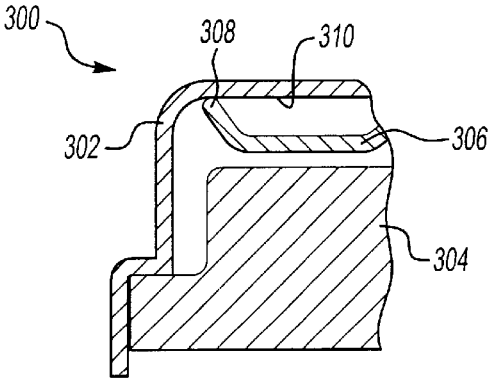
FIG. 17 shows another embodiment.

FIG. 17 shows an embodiment 300 wherein the end cap 302 is positioned outwardly of the non-orbiting scroll 304. The heat shield 306 is captured between the two, and has an axially upwardly extending radially outer portion 308, which contacts an interface 310 of the end cap 302.

Figure 18:
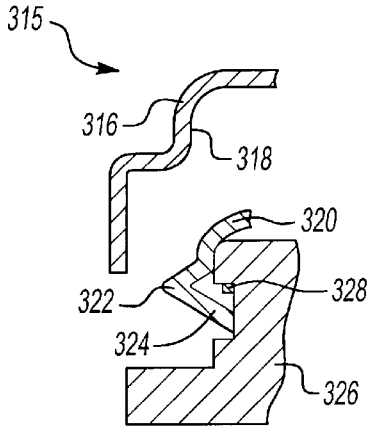
FIG. 18 shows another embodiment.

FIG. 18 shows an embodiment 315 wherein the end cap 316 has an inner portion 318 which will deform the heat shield 320 and a portion 322. The portion 322 extends to an axially lower end 324 extending into a ditch 328 in the non-orbiting scroll 326.

Figure 19:
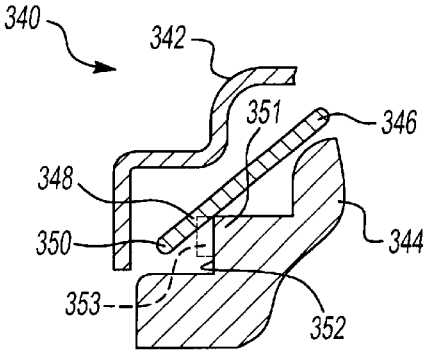
FIG. 19 shows another embodiment.

FIG. 19 shows yet another embodiment 340 wherein the end cap 342 is connected to the non-orbiting scroll 344. An intermediate heat shield 346 has a radially outwardly extending portion 348 which initially extends at an axially and radially outward angle 350. An end 351 on the non-orbiting scroll 344 provides a bend point such that when the end cap 342 is attached, the end 350 is bent to extend generally radially downwardly along the surface 352, and as shown at phantom in 353.

The heat shield is preferably formed of a material which is a better insulator than the material of the non-orbiting scroll. Examples of appropriate materials and further aspects of the structure of the heat shield can be best understood from a review of the co-pending patent application Ser. No. 09/451306.

Preferred embodiments of this invention have been disclosed, however, a worker of ordinary skill in the art would recognize that certain modifications would come within the scope of this invention. For that reason the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said second scroll member being driven to orbit relative to said first scroll member, and said wraps interfitting to define compression chambers which decrease as said second scroll member is driven to orbit;

a discharge port extending through said base of said first scroll member and into a discharge chamber, a suction chamber surrounding a drive shaft for said second scroll member;

a housing surrounding said scroll members, and including a central shell and an end cap; and a heat shield positioned between an outer periphery of said first scroll member and an inner periphery of said end cap, a portion of said heat shield being captured between said outer periphery of said first scroll member and said inner periphery of said end cap, and said portion being formed non-cylindrical in cross-section.

2. A scroll compressor as recited in claim 1, wherein said portion provides a seal.

3. A scroll compressor as recited in claim 2, wherein said portion is generally serpentine having a radially inwardly facing half in contact with said outer periphery of said first scroll and a radially outwardly facing half in contact with said inner periphery of said end cap to provide said seal.

4. A scroll compressor as recited in claim 2, wherein said portion is generally u-shaped with a radially outer end of said u being in contact with said inner peripheral surface of said end cap and a radially inwardly facing portion of said u being in contact with said outer periphery of said first scroll member.

5. A scroll compressor as recited in claim 2, wherein said portion is provided by a generally radially outwardly extending flange which extends circumferentially about said heat shield.

6. A scroll compressor as recited in claim 5, wherein a sealing material is placed on said radially outwardly extending flange to provide said seal.

7. A scroll compressor as recited in claim 5, wherein said radially outwardly extending flange is provided with a raised rib to provide said seal.

8. A scroll compressor as recited in claim 5, wherein a radially outermost portion of said flange is bent back radially inwardly to provide said seal.

9. A scroll compressor as recited in claim 1, wherein said portion is formed at circumferentially spaced location by formed clip portions.

10. A scroll compressor as recited in claim 9, wherein said formed clip portions extend radially inwardly into a groove in said outer periphery of said first scroll member.

11. A scroll compressor as recited in claim 10, wherein a seal between said discharge and said suction chambers is provided by said heat shield.

12. A scroll compressor as recited in claim 10, wherein a seal is provided between an additional surface of said outer periphery of said first scroll member which is in contact with said inner peripheral surface of said end cap to provide said seal.

13. A scroll compressor as recited in claim 1, wherein said heat shield is initially formed to have said non-cylindrical shape, but then is deformed into a generally cylindrical shape.

14. A scroll compressor as recited in claim 1, wherein said heat shield has a u-shaped portion extending axially downwardly into a groove in said non-orbiting scroll.

15. A scroll compressor as recited in claim 14, wherein said portion is generally serpentine having a radially inwardly facing half in contact with said outer periphery of said first scroll and a radially outwardly facing half in contact with said inner periphery of said end cap to provide said seal.

16. A scroll compressor as recited in claim 14, wherein said portion is generally u-shaped with a radially outer end of said u being in contact with said inner peripheral surface of said end cap and a radially inwardly facing portion of said u being in contact with said outer periphery of said first scroll member.

17. A scroll compressor as recited in claim 14, wherein said portion is provided by a generally radially outwardly extending flange which extends circumferentially about said heat shield.

18. A scroll compressor as recited in claim 1, wherein a circumferentially extending rib is formed on one of said heat shield and said non-orbiting scroll, and creates a seal point.

19. A scroll compressor as recited in claim 1, wherein said heat shield extends to an outer portion extending axially away from said non-orbiting scroll and into contact with an inner surface of said end cap.

20. A scroll compressor comprising:

a first scroll member having a base and a generally spiral wrap extending from said base;

a second scroll member having a base and a generally spiral wrap extending from its base, said second scroll member being driven to orbit relative to said first scroll member, and said wraps interfitting to define compression chambers which decrease as said second scroll member is driven to orbit;

a discharge port extending through said base of said first scroll member and into a discharge chamber, a suction chamber surrounding a drive shaft for said second scroll member;

a housing surrounding said scroll member, and including a central shell and an end cap; and a heat shield positioned between an outer periphery of said first scroll member and an inner periphery of said end cap, a portion of said heat shield being captured between said outer periphery of said first scroll member and said inner periphery of said end cap, and said portion being non-cylindrical in cross-section, said portion including a radially outer half and a radially inner half, both said radially outer and said radially inner halves extending generally around the entire circumference of said heat shield, said radially outer half providing a seal against said inner periphery of said end cap and said radially inner half providing a seal against an outer peripheral surface of said first scroll member.

21. A scroll compressor as recited in claim 20, wherein a sealing material is placed on said radially outwardly extending flange to provide said seal.

22. A scroll compressor as recited in claim 20, wherein said radially outwardly extending flange is provided with a raised rib to provide said seal.

23. A scroll compressor as recited in claim 20, wherein a radially outermost portion of said flange is bent back radially inwardly to provide said seal.

24. A scroll compressor comprising:

a first scroll member having a base and a generally spiral wrap extending from said base;

a second scroll member having a base and a generally spiral wrap extending from its base, said second scroll member being driven to orbit relative to said first scroll member, and said wraps interfitting to define compression chambers which decrease as said second scroll member is driven to orbit;

a discharge port extending through said base of said first scroll member and into a discharge chamber, a suction chamber surrounding a drive shaft for said second scroll member;

a housing surrounding said scroll member, and including a central shell and an end cap; and a heat shield positioned between an outer periphery of said first scroll member and an inner periphery of said end cap, a portion of said heat shield being captured between said outer periphery of said first scroll member and said inner periphery of said end cap, and said portion being non-cylindrical in cross-section, said portion providing a seal between said discharge chamber and said suction chamber.

* * * * *